US005954000A

United States Patent [19]

Panos

[11] Patent Number: 5,954,000

[45] Date of Patent: Sep. 21, 1999

[54] FLUID BED ASH COOLER

[75] Inventor: Paul J. Panos, Windsor, Conn.

[73] Assignee: Combustion Engineering, Inc., Windsor, Conn.

[21] Appl. No.: 08/934,669

[22] Filed: Sep. 22, 1997

[51] Int. Cl.[6] ..... F23J 1/00; F23J 1/02; F28D 13/00; F28D 15/00

[52] U.S. Cl. ..... 110/165 R; 110/168; 110/169; 110/165 A; 110/171; 110/245; 432/58; 432/15; 165/104.16; 165/104.18

[58] Field of Search ..... 110/169, 165 R, 110/168, 171, 165 A, 245; 122/4 D; 432/15, 58; 165/104.15, 104.16, 104.18, 920

[56] References Cited

FOREIGN PATENT DOCUMENTS 32 30 402 A1 12/1983 Germany ..... 110/169

*Primary Examiner*—Ira Lazarus
*Assistant Examiner*—Ljiljana V. Ciric
*Attorney, Agent, or Firm*—Robert S. Smith

[57] ABSTRACT

Apparatus for cooling ash exiting from circulating fluidized bed equipment includes an enclosure having a floor, a plurality of walls disposed around the floor and a ceiling. The enclosure also has an inlet and an outlet. The outlet is disposed in one of the walls near to the floor and the apparatus also includes tubing disposed within the enclosure for heat exchange relationship with ash entering the inlet of the ash cooler. In some forms of the invention the floor is planar and is disposed in oblique relationship to a horizontal plane. The outlet may be disposed proximate to the floor at the lowest elevational part thereof. The enclosure may be generally rectangular and may have first and second opposed sides and opposed third and fourth sides. The first and second sides are longer than the third and fourth sides. In some cases the ratio of the length of each of the first and second sides to the length of the third and fourth sides is two or three to one. In some embodiments the floor slopes downwardly from the third side to the forth side with the intersection of the floor with the first and second sides defining lines that are oblique with respect to a horizontal plane. The inlet may be disposed proximate to the third side.

2 Claims, 4 Drawing Sheets

FLUID BED ASH COOLER

BACKGROUND OF THE INVENTION

The invention relates to circulating fluidized bed combustor apparatus and particularly to apparatus for cooling the ash of a fluidized bed. Circulating fluidized bed apparatus is being increasingly utilized for a wide variety of applications. The use of a circulating fluidized bed is particularly advantageous because of technological developments which have resulted in significant advances in both operating and fuel flexibility. While the present invention has primary application to a combustion process in a steam generating system, it will be understood that the present invention may also be used in a wide variety of fluidized bed apparatus.

Fluidized bed combustion apparatus can burn coal efficiently at temperatures low enough to avoid many of the problems of combustion in other modes. The term "fluidized bed" refers to the condition in which solid materials are given free flowing, fluid-like behavior. As a gas is passed upward through a bed of solid particles, the flow of gas produces forces which tend to separate the particles from one another. At low gas flows, the particles remain in contact with other solids and tend to resist movement. This condition is referred to as a fixed bed. As the gas flow is increased, a point is reached at which the forces on the particles are just sufficient to cause separation. The bed is then deemed to be fluidized. The gas cushion between the solids allows the particles to move freely, giving the bed a liquid-like characteristic.

Fluidized bed combustion makes possible the burning of fuels having such a high concentration of ash, sulfur, and nitrogen that they would ordinarily be deemed unsuitable. By the use of this process it is possible, at least in most cases, to avoid the need for gas scrubbers while still meeting emissions requirements. In fluidized bed combustion, the fuel is burned in a bed of hot incombustible particles suspended by an upward flow of fluidizing gas. Typically the fuel is a solid such as coal, although liquid and gaseous fuels can be readily used.

The fluidizing gas is generally combustion air or the gaseous products of combustion. Two main types of fluidized bed combustion systems are (1) bubbling fluid bed (BFB) in which the air in excess of that required to fluidize the bed passes through the bed in the form of bubbles. The bubbling fluid bed is further characterized by modest bed solids mixing rate and relatively low solids entrainment in the flue gas and (2) circulating fluid bed (CFB) which is characterized by higher velocities and finer bed particle sizes. In such systems the fluid bed surface becomes diffused as solids entrainment increases, such that there is no longer a defined bed height. Circulating fluid bed systems have a high rate of material circulating from the combustor to the particle recycle system and back to the combustor. Characteristics of apparatus of this general type are further described in the publication *Combustion Fossil Power,* edited by Joseph G. Singer, P.E. and published by Combustion Engineering, Inc.; a subsidiary of Asea Brown Boveri, 1000 Prospect Hill Road, Windsor, Conn. 06095 (1991 edition).

In a conventional circulating fluidized-bed steam generator crushed fuel and sorbent are fed mechanically or pneumatically to the lower portion of a combustor. Primary air is supplied to the bottom of the combustor through an air distributor, with secondary air fed through air ports at one or more elevations in the lower part of the combustor. Combustion takes place throughout the combustor, which is filled with fluidized bed material. Flue gases and entrained solids leave the combustor and enter one or more cyclones where the larger solids are separated and fall to a seal pot. From the seal pot, the solids are recycled to the combustor. Optionally, some solids may be diverted through a plug valve to an external fluidized-bed heat exchanger (FBHE) and back to the combustor. In the FBHE, tube bundles absorb heat from the fluidized solids.

The present invention has application to any fluidized bed apparatus, however, it has particular application to circulating fluid bed boilers operating with a fuel that produces more than the usual amount of ash. Such fuels may be referred to as high ash fuels. A high ash fuel is a fuel having an ash that weighs 35% or more of the weight of the fuel. (Low ash fuels typically do not require a fluid bed ash cooler although some may be cooled with cooling apparatus such as a screw cooler. Screw coolers have a jacketed sleeve around a helix that it is rotated to move solid matter axially within the sleeve.) The ash produced in the fluid bed includes both the backpass ash and the bottom ash. It is essential that the temperature of the ash leaving the combustor be cooled so that the ash does not damage or destroy the conveying equipment.

The bottom ash should be cooled from combustor temperature to below 500 degrees Fahrenheit before entering the bottom ash conveying system. When a high ash fuel is used, the heat in the bottom ash stream may represent a significant percentage of boiler heat input. Consequently, it can be desirable to recover this heat. Fluidized bed ash coolers are generally used for this purpose. The fluidized bed ash cooler has a bubbling fluidized bed heat exchanger identical in design to the fluidized bed heat exchanger. Cooling coils immersed in the bed cool the ash and transfer heat to condensate or boiler feed water. Ash flow from the combustor 10 to the fluidized bed ash cooler 34 is optionally controlled by a cone valve as with the fluidized bed heat exchanger. However, a V-port or any control valve may be used to control the flow of ash into the ash cooler. Cooled ash from the ash cooler passes to the bottom ash handling system for transport to storage. This is usually a mechanical system consisting of flight conveyor's, although a pressured pneumatic system can also be used. Alternately, a mechanical system can be used to transport bottom ash to an intermediate hopper, from which a pneumatic system conveys the material to storage.

It is the usual in the prior art to position the outlet of the ash cooler above the bottom surface of the ash cooler. In other words, the outlet is at the end of a pipe which is raised above the bottom of the ash cooler so that some ash always remains in the ash cooler. This construction is satisfactory for many applications. However, for some applications this construction complicates the removal (from the ash cooler) of large particles that have not been fluidized can not easily be removed from the ash cooler.

The prior art coolers have traditionally been provided with a horizontal floor and typically been provided with a weir. The weir constrains the ash within the ash cooler. A disadvantage of such constructions is that the lighter particles move to the upper surface and the heavier particles move to the bottom. The lighter particles will flow over the weir and exit the ash cooler. The heavier particles have to be removed separately.

It is also usual in the prior art to provide an ash cooler that is substantially square as viewed from above. This construction has now been found to limit heat transfer. More specifically, ash entering a generally square ash cooler typically can flow to an outlet located at one side thereof without having substantial contact with heat exchange surfaces that may extend over substantially the entire floor of the ash cooler. This is unsatisfactory from a thermodynamic standpoint.

OBJECTS AND SUMMARY OF THE INVENTION

A primary object of the invention is provide an ash cooler apparatus which uses the surface and volume of the ash cooler more effectively.

Another object of the invention is to provide apparatus which will facilitate the removal from the ash cooler of the relatively large particles.

It has now been found that these and other objects of the invention may be attained in an ash cooler for cooperation with an associated fluidized bed which includes an enclosure having a floor, a plurality of walls disposed around the floor and a ceiling. The enclosure has an inlet and an outlet. The outlet is disposed in one of the walls proximate to the floor and the apparatus also includes watercooled tubing disposed within the enclosure for heat exchange relationship with associated ash entering the inlet of the ash cooler. In some forms of the invention the floor is planar and is disposed in oblique relationship to a horizontal plane. The outlet may be disposed proximate to the floor at the lowest elevational part thereof and the enclosure may be generally rectangular and may have first and second opposed sides and opposed third and forth sides and the first and second sides are longer than the third and fourth sides. In some cases the ratio of the length of the first and second sides to the length of the third and fourth sides is two or three to one.

In some embodiments the floor slopes downwardly from the third side to the forth side with the intersection of the floor with the first and second sides defining lines that are oblique with respect to a horizontal plane. The inlet is disposed proximate to the third side.

The ash cooler may further includes a plurality of nozzles extending from the floor. The plurality of nozzles each have a head disposed above the floor and directing a fluid toward the fourth side whereby ash deposited within the enclosure is urged by fluid passing through the nozzles to move toward the fourth side.

Other forms of the invention may further include a plurality of ducts or headers supplying air to the enclosure underneath the floor.

BRIEF DESCRIPTION OF THE DRAWING

The invention will be better understood by reference to the accompanying drawing in which.

DESCRIPTION OF THE PREFERRED EMBODIMENT

Figure 1:
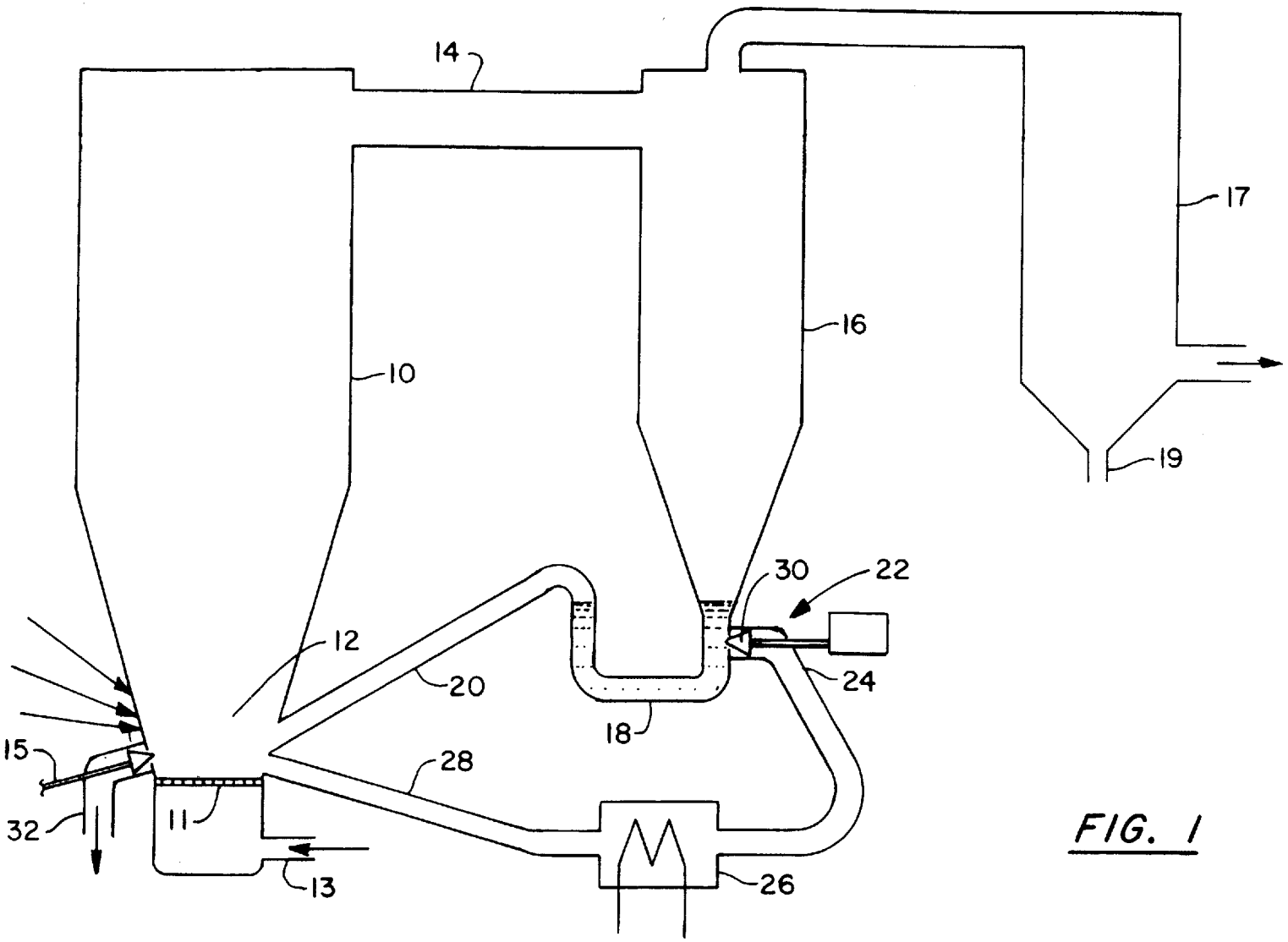
FIG. 1 is a partially schematic elevational view of a circulating fluidized bed combustor apparatus that produces the ash that is cooled by the ash cooling apparatus in accordance with the present invention.

Referring now to the overall schematic of FIG. 1 there is shown a vertically elongated combustor 10 in which is disposed a circulating fluidized bed 12. The circulating fluidized bed 12 is disposed on a base plate 11. Primary air is supplied to the bed 12 through a port 13 disposed below the base plate 11. Secondary air, limestone and fuel are directed into the side of the bed 12 as indicated by the three arrows on the left side (as viewed) of the combustor 10. The air, limestone, and fuel in the bed 12 react in a combustion process within the combustor. The fuel typically is a fossil fuel. The limestone is a sorbent. A bottom ash control valve 15 is also disposed on the left side of the combustor 10. The particles in the circulating fluidized bed 12 are recirculated through a gas pass 14 to one or more cyclones 16 (one shown). Each cyclone 16 is vertically elongated and has the lower extremity connected to a seal pot 18. The top of each cyclone 16 is coupled to a back pass 17 that contains additional heat transfer surfaces. The arrow indicating movement out of the back pass 17 indicates flue gas flow to a dust removal apparatus and a stack (not shown). Additional ash is removed from the lower extremity 19. Each seal pot 18 has a shape and function somewhat comparable to the trap commonly connected to the drain of residential and commercial sinks. The seal pot 18 is coupled to the combustor 10 by a first return duct 20. An ash control valve 22 modulates flow out of the seal pot 18 through a refractory lined housing 24 that is coupled to a heat exchanger 26 and a second return duct 28. The second return duct 28 completes the path from the seal pot 18, through the heat exchanger 26 to the combustor 10. The first and second return ducts 20, 28, as well as the seal pot 18, are refractory lined.

The purpose of the bottom ash control valve 15 is to allow the exit of ash from the bed 12 through the pipe 32. Typically, the bottom ash that is passed through the bottom ash control valve 15 is cooled and thrown away. The present invention is particularly directed to the cooling of this ash.

Figure 2:
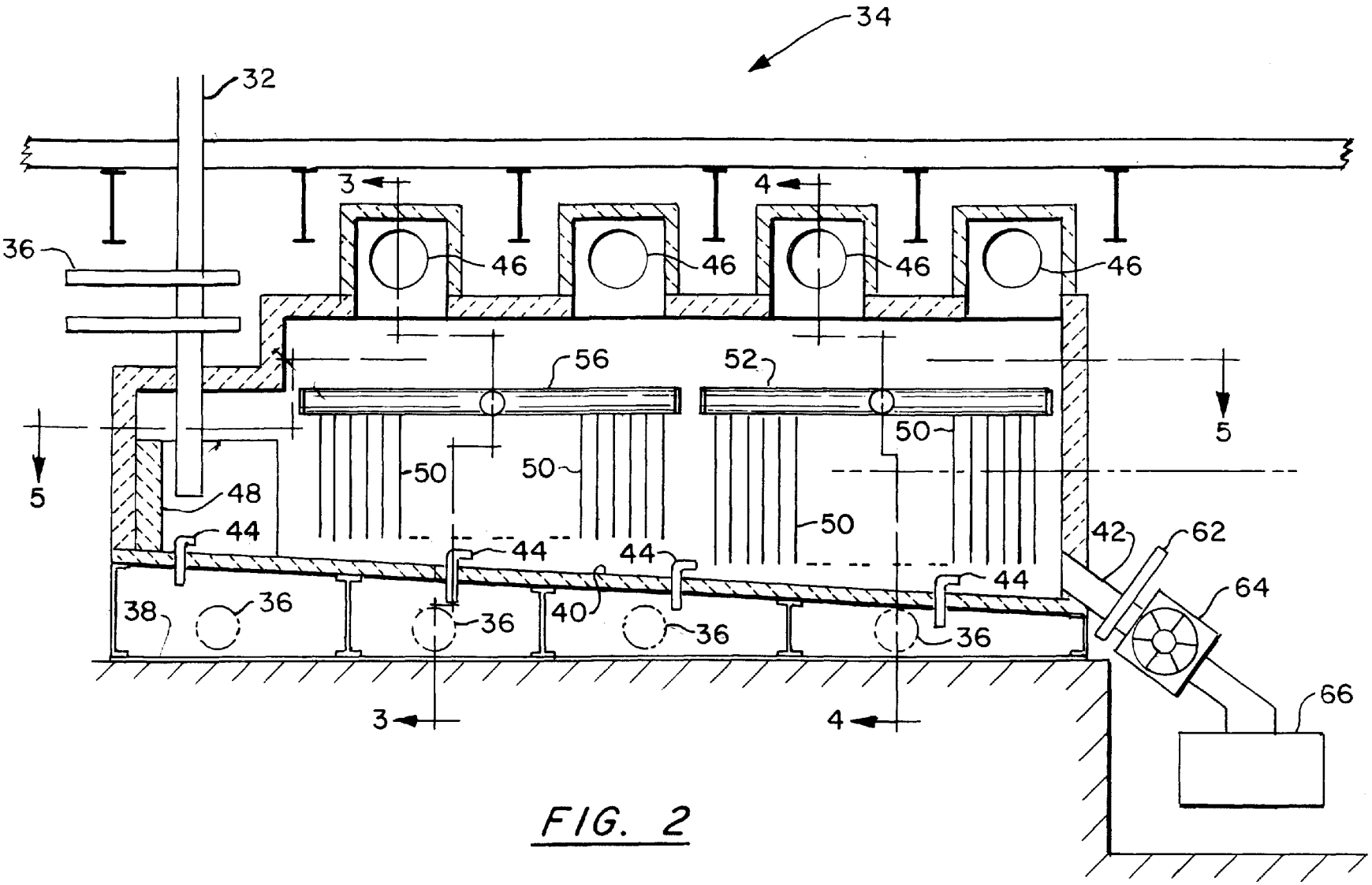
FIG. 2 is elevational view of the cooler in accordance with one form of the present invention.
Figure 3:
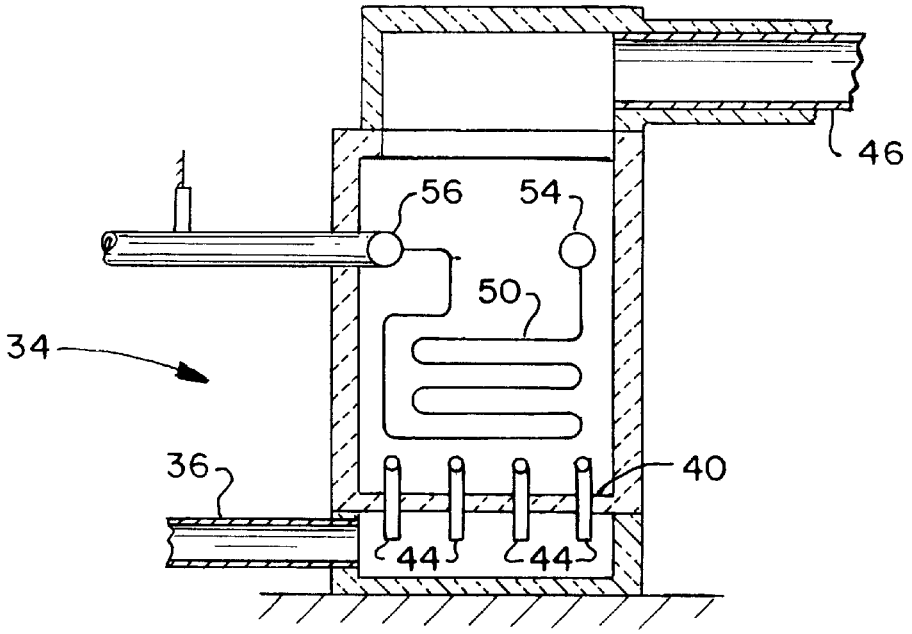
FIG. 3 is a sectional view taken along the line 3—3 of FIG. 2.
Figure 4:
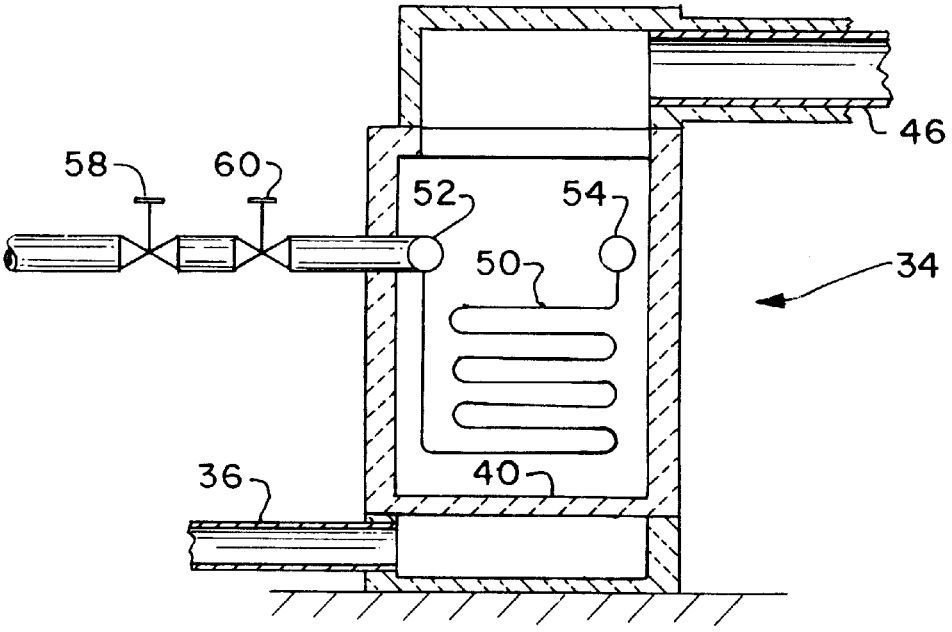
FIG. 4 is a sectional view taken along the line 4—4 of FIG. 2.

Referring now to FIGS. 2–4 there is shown the ash cooler 34 in accordance with one form of the present invention. The ash cooler 34 has an inlet that is coupled the pipe 32. Thus, the ash cooler 34 receives the hot ash from the combustor 10 when the valve 15 is opened. The flow continues through the pipe 32 and through a schematically represented isolation valve 36. (The isolation valve 36 as well as the isolation valve 62 to been described hereafter are provided for isolation of system components during maintenance.) The ash cooler 34, like other ash coolers, cools the hot ash by fluidizing it with air and transferring its heat to tubing 50 disposed within the bed. The tubing 50 is cooled by water or other heat exchange fluid flowing within the tubing 50. Typically the ash has an average size of between 100 microns and 1500 microns. Individual ash particles range in sizes from a maximum of 25 mm to a minimum size that is similar to flyash.

In the ash cooler 34 the ash is fluidized by air flowing in through the ducts 36 into a chamber bed defined by the bottom 38 of the ash cooler 34 and a sloping floor 40. The floor 40 is planar and slopes from a maximum elevation near the inlet pipe 32 to a minimum elevation near an outlet 42. A plurality of an L-shaped nozzles 44 extend through the floor 40. The nozzles 44 are pointed in the direction of the outlet 42. Thus, the ash disposed within the ash cooler 34 is urged toward the outlet 42. The gas entering the ash cooler 34 through the ducts 36 passes upwardly within the ash cooler 34 and out the ducts 46.

Figure 5:
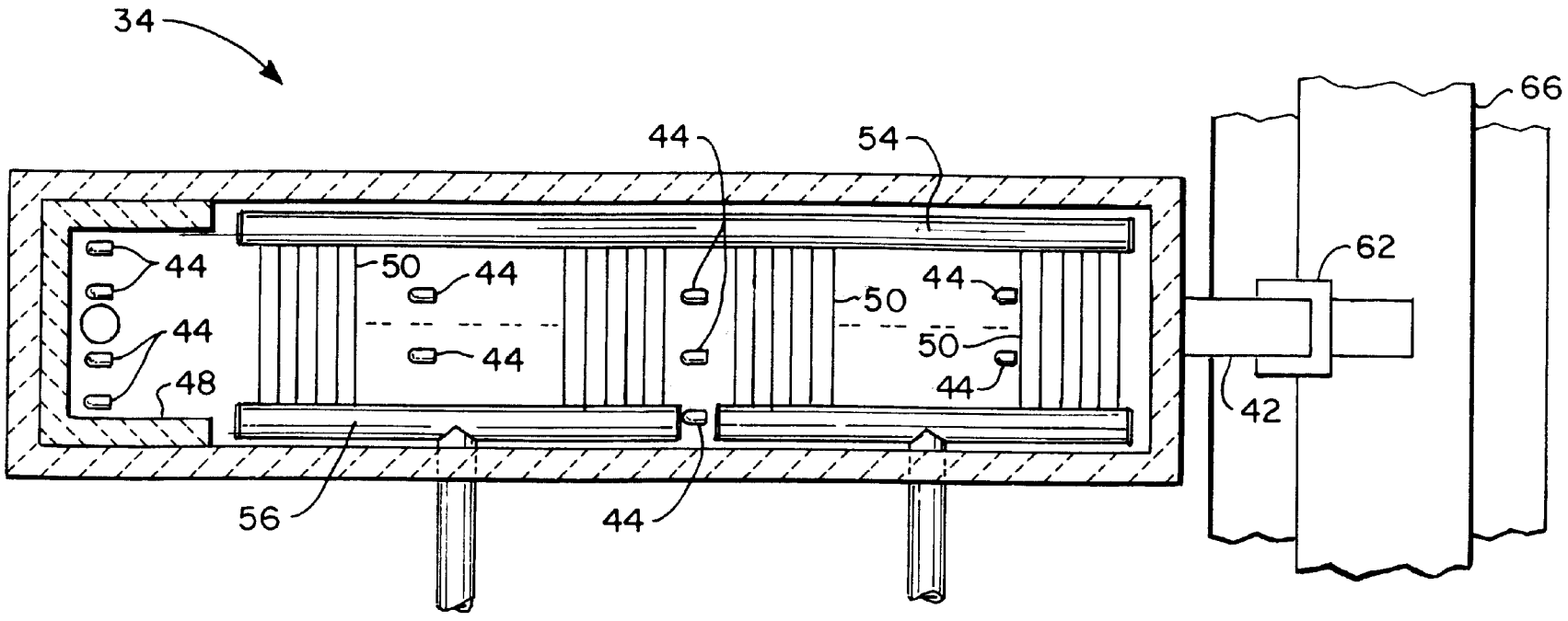
FIG. 5 is a sectional view taken along the line 5—5 of FIG. 2.

The ash flowing into the ash cooler 34 by way of the pipe 32 enters a portion thereof that is lined with extra refractory material 48. The extra refractory material 48 is necessary at this part of the ash cooler 34 because the ash coming in the plate 32 has the hottest temperature at the inlet of the ash cooler 34. As the ash progresses along the downwardly sloped floor 40 it passes over the tubing 50 due to (1) the influence of gravity and (2) the nozzles 44. The tubing 50 extends intermediate an inlet header 52 and a common header 54 (as best seen in FIG. 5) as well as between the common header 54 and the outlet header 56. Valves 58, 60 control the flow of coolant such as condensate into the inlet header 52.

Disposed in the outlet 42 is an isolation valve 62 and a rotary valve 64 which meters the flow of ash out of the ash cooler 34 to a conventional scraper conveyor 66. The rotary valve 64, in the conventional manner has rotating vanes within a circular chamber that allow measured amounts to move from the inlet of the valve to the outlet of the valve.

The ash cooler 34 in accordance with 14 of the invention has the ash outlet 42 disposed at the floor 40 level. More specifically, will be apparent from FIG. 2 the side of the outlet 42 abuts the floor 40. This location is advantageous since it permits the removal of large ash particles that have not been fluidized.

The apparatus in accordance with a preferred form of the invention has a preferred aspect ratio. More specifically, it is preferred that the ash cooler has a length to width ratio of at least 3:1. Other embodiments may have an aspect ratio of at least 2:1. This tends to avoid the problem with the prior art in which most of the flow and heat transfer was concentrated at the geometric center of the ash cooler and effectively bypasses much of the entire surface area of the heat exchange tubing. It will be understood that in the prior art, the contact between the hot ash and the tubes disposed near a horizontally extending floor was very limited.

It will thus the same that the apparatus in accordance with the present invention more effectively uses the volume and area of the ash cooler and also facilitates the removal of larger, heavy ash particles from the ash cooler.

The invention has been described with respect to its preferred embodiment. Persons skilled in the art of such devices may upon exposure to the teachings herein conceive other variations. Such variations are deemed to be encompassed by the disclosure, the invention being delimited only by the following claims.

I claim:

1. An ash cooler for cooperation with an associated fluidized bed that produces a hot ash, said ash cooler comprising:

an enclosure having a floor, a plurality of walls disposed around said floor and a ceiling, said enclosure having an inlet and an outlet, said outlet being disposed in one of said walls, said outlet being proximate to said floor, said floor being planar and disposed in oblique relationship to a horizontal plane, said outlet being disposed proximate to said floor at the lowest elevational part of said floor, said enclosure being generally rectangular and having first and second sides that are opposed and third and fourth sides that are opposed, each of said first and second sides being longer than each of said third and fourth sides, each of said first and second sides being at least twice as long as each said third and fourth sides, said floor sloping downwardly from said third side to said fourth side, said first and second sides intersecting said floor, the intersection of said floor with said first and second sides defining lines that are oblique with respect to a horizontal plane, said inlet being disposed proximate to said third side, a plurality of nozzles extending from said floor, said plurality of nozzles each having a head disposed above said floor, each nozzle of said plurality of nozzles being positioned to direct a fluid toward said fourth side whereby associated ash deposited within said enclosure is urged by the fluid passing through said nozzles to move toward said fourth side, a plurality of ducts supplying air to said enclosure underneath said floor, a plurality of exhaust ducts intersecting said enclosure and allowing removal of gases from said enclosure;

an intake header;

an exhaust header;

a plurality of tubes extending from said intake header to said exhaust manifold, said plurality of tubes being disposed within said enclosure in heat exchange relationship with ash entering said inlet of said ash cooler; and a rotary valve cooperating with said outlet, said rotary valve allowing measured amounts of ash to exit said outlet.

2. The ash cooler as described in claim 1 wherein:

each of said first and second sides are at least three times as long as each of said third and fourth sides.

* * * * *